US008006439B2

(12) United States Patent
Hauer et al.

(10) Patent No.: US 8,006,439 B2
(45) Date of Patent: Aug. 30, 2011

(54) CLOSING DEVICE

(75) Inventors: Jean-Claude Hauer, Saulxures lés Nancy (FR); Francis Berthon, Pompey (FR)

(73) Assignee: Saint-Gobain Pam-CRD, Nancy (FR)

( * ) Notice: Subject to any disclaimer, the term of this patent is extended or adjusted under 35 U.S.C. 154(b) by 1190 days.

(21) Appl. No.: 10/684,464

(22) Filed: Oct. 15, 2003

(65) Prior Publication Data

US 2004/0128919 A1 Jul. 8, 2004

(30) Foreign Application Priority Data

Dec. 23, 2002 (FR) ..... 02 16569

(51) Int. Cl.
*E02D 29/14* (2006.01)

(52) U.S. Cl. ..... 52/19; 52/20

(58) Field of Classification Search ..... 52/19, 20, 52/21; 49/386, 378, 381; 404/25, 26
See application file for complete search history.

(56) References Cited

U.S. PATENT DOCUMENTS

| | | | | |
|---|---|---|---|---|
| 2,012,885 | A * | 8/1935 | Lovatt | 49/368 |
| 4,840,514 | A * | 6/1989 | Defrance et al. | 404/25 |
| 6,679,651 | B2 * | 1/2004 | Robinson | 404/25 |

FOREIGN PATENT DOCUMENTS

| | | |
|---|---|---|
| EP | 0 391 825 A1 | 3/1990 |
| WO | WO 00/11272 | 3/2000 |

* cited by examiner

*Primary Examiner* — Basil Katcheves
(74) *Attorney, Agent, or Firm* — Sughrue Mion, PLLC

(57) ABSTRACT

This device for closing an opening includes a frame (4) that delimits a pass-through access opening (10) suitable for receiving a cover (6) and which includes a frame hinge knuckle (18). The frame hinge knuckle (18) includes a hinge surface (38) and a pass-through hinge knuckle opening (40). The frame (4) has an exterior side and an interior side. The device also includes an inserted plug (52) positioned in a recess (50) of the frame hinge knuckle (18) located on the inner side of the hinge surface (38) and which makes the inner side of the frame hinge knuckle (18) appreciably sealed off from the outside.

26 Claims, 1 Drawing Sheet

CLOSING DEVICE

Figure 1:
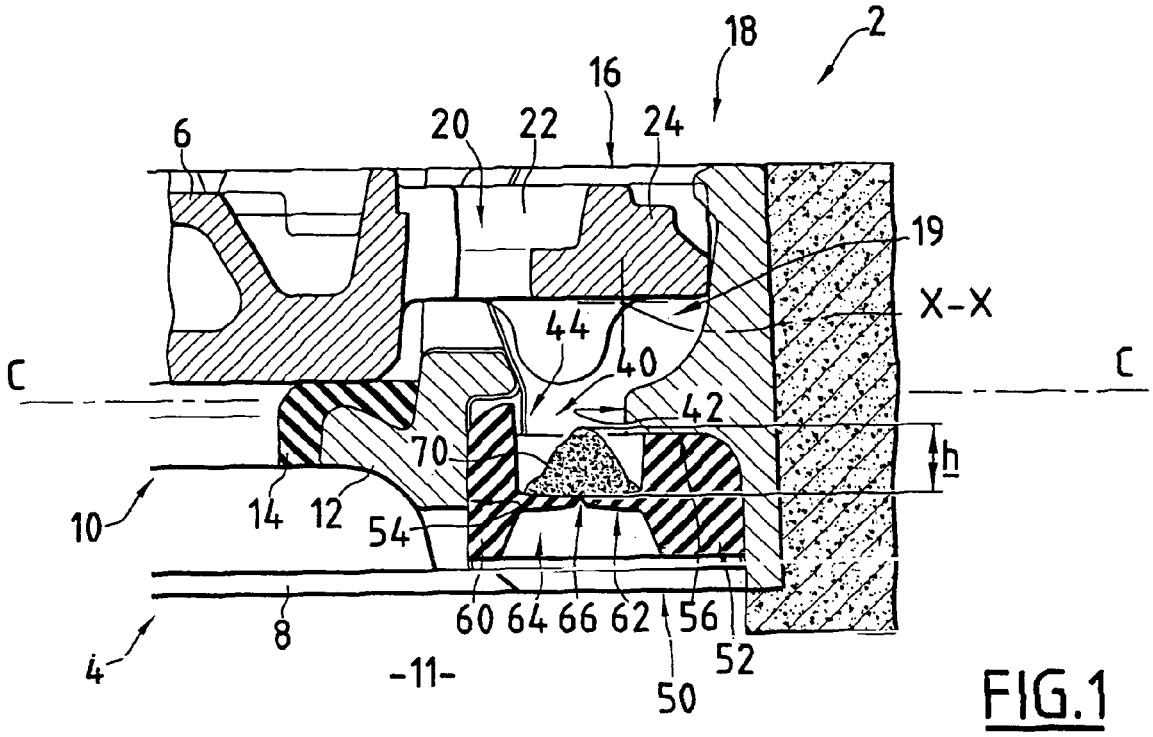

The present invention concerns a device for closing an opening, of the type comprising a frame that delimits a pass-through access opening suitable for receiving a cover and which includes a frame hinge knuckle, the frame hinge knuckle having a hinge surface and a pass-through hinge knuckle opening, the frame having an outer side and an inner side.

The invention applies in particular to cast iron manholes for streets or sidewalks.

Known from the document EP-B-391 825 is a manhole that allows access to a network of underground pipes, such as a sewer system. This manhole includes an articulated cover mounted on a fixed frame by means of a hinge. Said hinge allows the cover to be lifted from the frame by pivoting around a hinge pin.

The hinge includes a hinge knuckle formed by a recess made in the frame. This recess is open upward and suitable for receiving a cover hinge knuckle provided on the cover.

Furthermore, the manhole is provided with means for locking the cover in a secure open position in which the cover cannot be closed again accidentally.

To that end, the recess of the frame comprises a through-hole which delimits the application surfaces of the cover hinge knuckle in its open position.

Because the recess includes a through-hole, this manhole is not completely watertight. Consequently, rainwater can penetrate into the sewer system and flood it.

A purpose of the invention, therefore, is to remedy this disadvantage and to propose a road maintenance device that has a better seal against runoff waters.

To that end, a purpose of the invention is a device of the above-mentioned type, characterized in that the device also includes an inserted plug positioned in a recess of the frame hinge knuckle located on the inner side of the hinge surface and which makes the inner side of the frame hinge knuckle appreciably sealed off from the outside.

According to particular forms of embodiment of the invention, the device includes one or more of the following characteristics:

- the plug is made from an elastically deformable material, particularly of one single piece, and especially of elastomer;
- the plug comprises an exterior side, turned toward the hinge surface and means of evacuating dirt accumulated on the outer side of the plug;
- the means of evacuating dirt comprise at least one elastically deformable element that is movable between a blocking position in which it blocks the recess and retains the accumulated dirt on the outer side of the plug, and a pass-through position in which it opens the recess and allows the dirt to be evacuated from the outer side toward the inner side of the frame through the hinge knuckle opening;
- the frame extends along a frame plane and the movable element comprises at least a movable sealing lip bending around an axis positioned parallel to the frame plane;
- the hinge knuckle opening delimits at least a blocking surface of the cover in an open position;
- moreover, the device comprises a cover suitable for closing off the access opening, the cover being able to be moved between open and closed positions and including a cover hinge knuckle that cooperates with the frame hinge knuckle;
- the cover hinge knuckle is suitable for taking the movable element to its pass-through position when the cover is taken to its open position and when the amount of dirt has exceeded a predetermined threshold; and
- the device is a manhole.

Figure 2:
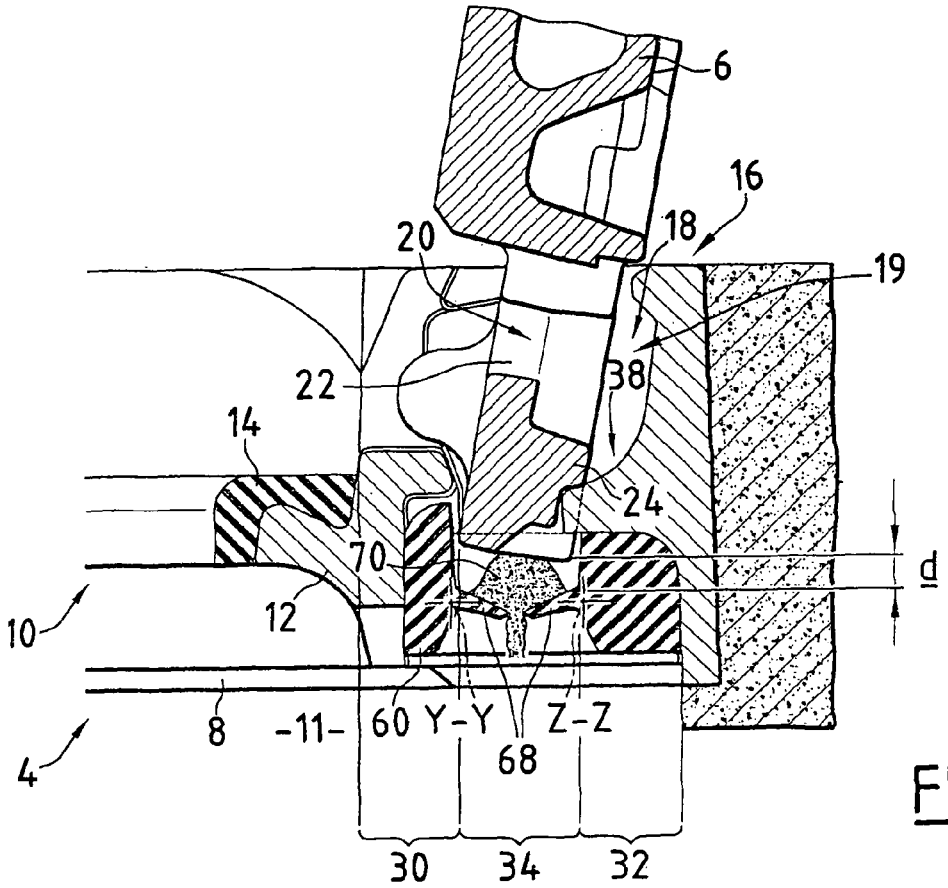

The invention will be better understood from the following description, given solely by way of example, and with reference to the attached drawings in which:

FIG. 1 is a transverse cross section of a part of a manhole according to the invention, the cover being in a closed configuration; and FIG. 2 is a view similar to FIG. 1, the cover being in an open blocking configuration.

Represented in FIG. 1 is a manhole according to the invention, designated by the general reference of 2.

This manhole 2 includes a frame 4 and a cover 6, made of cast iron. The cover 6 is articulated with reference to the frame 4 around a generally horizontal axis X-X. The frame 4 extends along an appreciably horizontal frame plane C-C and includes a base body 8 that delimits a circular opening 10. When the manhole 2 is installed, this circular opening 10 is placed in line with a pipe 11 or a well with a generally vertical axis. The manhole 2 comprises an outer side opposite the pipe 11, at the top in the Figures, as well as an inner side toward the pipe 11, at the bottom in the Figures.

The base body 8 includes, on the side radially inside the opening 10, an internal peripheral projection 12, on which an elastomer gasket 14 is positioned. The outer surface of the gasket 14 is used as the support surface for the cover 6 when said cover is in the closed position.

The cover 6 generally has a circular disk shape, the diameter of which corresponds approximately with the diameter of the opening 10.

The manhole 2 also includes at its periphery a hinge 16 that connects the cover 6 to the base body 8 and provides the articulation of the cover 6 with reference to the frame 4 around the axis X-X. Thus, the cover 6 can be moved between a closed position in which the cover is generally horizontal (FIG. 1) and a fully open position in which the cover 6 is swung about 130° with reference to its closed position, the cover 6 also being able to occupy an open blocking position in which it makes an angle of between about 90° and 110° with respect to its closed position (FIG. 2).

The hinge 16 can have a closing configuration as well as various opening configurations, one of which is an open blocking configuration, which correspond to the above-mentioned positions of the cover 6.

The hinge 16 includes a frame knuckle 18, integral with the frame 4, and a cover knuckle 20, integral with the cover 6.

In this instance the hinge knuckle of the cover 20 is comprised of a protrusion 22 of the cover 6 which extends parallel to the plane of the cover 6 and which is terminated by a pivot 24.

The frame hinge knuckle 18 includes an outer recess 19 which is open to the external side and which includes first 30, second 32 and third domains 34.

The first domain 30 is adjacent to the opening 10 and is suitable for receiving a portion of the protrusion 22 adjacent to the cover 6, when said cover is in the closed position.

The second domain 32 is separated from the first domain 30 and includes a bottom profile 38 in the shape of a partial cylinder with circular cross section, the axis of which coincides with the axis X-X. This bottom profile 38 forms a hinge surface forming [a] cam for the pivot 24.

The third domain 34 is positioned between the first 30 and second 32 domains. This third domain 34 includes a pass-through hinge knuckle opening 40. This opening 40 is suitable for receiving the pivot 24 when the hinge 16 is in the open blocking configuration (FIG. 2). The pass-through opening 40 extends from the inner side of the hinge surface 38. The pass-through opening 40 forms, at the interface between the three domains 30, 32, 34, two flat blocking surfaces 42, 44 which extend vertically and parallel to the axis X-X and which enable the cover 6 to be locked in the open blocking position so that it cannot be closed again accidentally.

The hinge 16 is of a known type and is described in detail in the above-mentioned document EP-B-391 825.

Moreover, a receiving recess 50 is made in the in the frame hinge knuckle 18, said receiving recess 50 including an inserted plug 52.

The receiving recess 50 is positioned on the inner side of the pass-through opening 40, adjacent thereto, so that the pass-through opening 40 opens out into said inner recess 50.

The recess 50 is delimited on the one hand by a peripheral wall 54 that extends parallel to the wall of the pass-through opening 40 and which encloses said opening, and on the other hand by a bottom wall 56 extending parallel to the plane C-C.

The plug 52 includes a peripheral wall 60, and positioned approximately at mid-height thereof, a central membrane 62. The peripheral wall 60 is applied elastically and sealably against the peripheral wall 54 of the receiving recess 50 and goes completely around said recess. It should be noted that the peripheral wall 60 is slightly compressed by the peripheral wall 54. Said peripheral wall 60 forms a passage 64 extending from the pass-through opening 40 toward the interior.

The central membrane 62 is flexible and extends appreciably parallel to the plane C-C over all of the transverse section of the passage 64. The central membrane 62 includes a median groove 66 which divides the membrane 62 into two sealing lips 68, each of which lips is integral with the peripheral wall 60 only by one single edge.

Each sealing lip 68 is flexibly movable around an axis Y-Y, respectively Z-Z, between a blocking position (FIG. 1) and a pass-through position (FIG. 2).

In their blocking position, the ends of the sealing lips 68 abut against each other and close off the passage 64, making the inner side of the frame hinge knuckle 18 appreciably sealed off from the exterior.

In their pass-through position, the sealing lips 68 are separated from each other and allow dirt such as gravel 70 to pass through.

It should be noted that the central membrane 62 is positioned in such a way that the pivot 24 extends a distance d from the membrane when the hinge 16 is in the open and blocking configuration.

The outer part of the peripheral wall 60 and the central membrane 62 delimit a container for dirt in which the gravel 70, for example, can accumulate.

The plug 52 is manufactured economically, preferably from a single piece, by molding elastically deformable material. A particularly suitable material, for example, is an elastomer such as EPDM (ethylene-propylene-diene copolymer) or SBR (styrene-butadiene rubber). Preferably the material of the plug has a Shore hardness of between 50° and 70°.

The manhole according to the invention functions as follows.

Initially, the cover 6 is in the closed configuration (FIG. 1).

The pivot 24 extends into the upper part of the frame hinge knuckle 18, and the cover 6 extends generally horizontally.

The gravel 70 that enters into the frame hinge knuckle 18 from the outside is located on the membrane 62 in the dirt container, and the gravel forms a pile, the height h of which is greater than the distance d. The sealing lips 68 are in their blocking position.

When it rains, the water accumulates in the frame hinge knuckle 18 and in the dirt container, most of this flow of water being prevented from penetrating into the pipe 11 or into the well through the passage 64. This considerably reduces the flooding of the underground sewer system by this rainwater.

When the cover 6 is swung into its open blocking position, the pivot 24 penetrates into the pass-through opening 40 of the third domain 34 and is applied on the blocking surfaces 42, 44 in order to block the cover 6 in this open position.

When the pivot 24 is inserted into the opening 40, it presses against the gravel 70 which transmits the force of pressure to the sealing lips 68. They in turn are deflected inward and thus take their pass-through position, allowing the gravel 70 to be evacuated by falling through the passage 64. When enough gravel 70 has fallen through the passage, the sealing lips 68 reclose due to their own elasticity and again provide a seal.

Consequently, as a result of the flexible lips 68, dirt that may accumulate in the frame hinge knuckle 18 does not prevent the holding of the cover 6 in the locked open position.

It should be noted that the invention can also be applied in the domain of traps intended to close technical inspection chambers for underground wired networks when the closure covers are articulated and it is desired to prevent the penetration of rainwater through the hinge into these technical chambers.

The invention claimed is:

1. A closing device, comprising:

a frame (4) defining an access opening 10 and a cover (6) for the frame which is movable relative to the frame between an open and a closed position of opening and closing the access opening 10 defined by the frame, the frame including an inner side and an outer side, the frame including a frame hinge knuckle (18), the frame hinge knuckle (18) having a hinge surface (38) and a pass-through hinge knuckle opening (40) that is located between an outer recess open to the outer side of the frame and an inner recess open to the inner side of the frame, said cover including a cover hinge knuckle that cooperates with the frame hinge knuckle and comprises a pivot extending into the outer recess when the cover is in the closed position, wherein the inner recess comprises an opening and the device also comprises an inserted plug (52) positioned in the inner recess (50) to close the opening of the inner recess and which makes the inner side of the frame hinge knuckle (18) appreciably sealed off from the outside and wherein the plug is located below the cover hinge knuckle.

2. Device according to claim 1, characterized in that the plug (52) is made from an elastically deformable material.

3. Device according to claim 2, characterized in that the plug (52) comprises means of evacuating (62) dirt (70) accumulated on the outer side of the plug (52).

4. Device according to claim 2, characterized in that the hinge knuckle opening (40) delimits at least a blocking surface (42, 44) of the cover (6) in an open position.

5. Device according to claim 2, characterized in that the device is a manhole (2).

6. Device according to claim 2, wherein the plug is made of a single piece.

7. Device according to claim 2, wherein the plug is made of an elastomer.

8. Device according to claim 1, characterized in that the plug (52) comprises means of evacuating (62) dirt (70) accumulated on the outer side of the plug (52).

9. Device according to claim 8, characterized in that the means of evacuating dirt comprise at least one elastically deformable element (68) that is movable between a blocking position in which it blocks the inner recess (50) and retains the accumulated dirt on the outer side of the plug (52), and a pass-through position in which it opens the inner recess (50) and allows the dirt to be evacuated from the outer side toward the inner side of the frame through the hinge knuckle opening (40).

10. Device according to claim 8, characterized in that the hinge knuckle opening (40) delimits at least a blocking surface (42, 44) of the cover (6) in an open position.

11. Device according to claim 8, characterized in that the device is a manhole (2).

12. Device according to claim 9, characterized in that the frame (4) extends along a frame plane and the elastically deformable element comprises at least a movable sealing lip (68) bending around an axis positioned parallel to the frame plane.

13. Device according to claim 9, characterized in that the cover knuckle (20) is suitable for taking the elastically deformable element (68) to its pass-through position when the cover (6) is taken to its open position and when the amount of dirt has exceeded a predetermined threshold (d).

14. Device according to claim 9, characterized in that the hinge knuckle opening (40) delimits at least a blocking surface (42, 44) of the cover (6) in an open position.

15. Device according to claim 9, characterized in that the device is a manhole (2).

16. Device according to claim 12, characterized in that the hinge knuckle opening (40) delimits at least a blocking surface (42, 44) of the cover (6) in an open position.

17. Device according to claim 12, characterized in that the device is a manhole (2).

18. Device according to claim 1, characterized in that the hinge knuckle opening (40) delimits at least a blocking surface (42, 44) of the cover (6) in an open position.

19. Device according to claim 1, characterized in that the device is a manhole (2).

20. A closing device according to claim 1, wherein the plug comprises two sealing lips;

wherein the sealing lips extend toward one another and ends of the sealing lips meet.

21. A closing device, comprising:

a frame disposed in an access opening and including a hinge receiving portion;

a cover which closes the access opening and comprises a hinge portion which is received by the frame at said hinge receiving portion; and a plug separate from said cover and disposed below the hinge portion of the cover;

wherein the hinge receiving portion includes an outer recess, an inner recess and a pass-through opening through which the outer recess and the inner recess communicate; and wherein the hinge portion of the cover is received in the outer recess of the hinge receiving portion and said plug is disposed in the inner recess and substantially closes an opening of the inner recess at least when the cover is closed.

22. A device according to claim 21, wherein said plug is capable of blocking dirt or gravel.

23. A device according to claim 22, wherein when said cover is opened, a portion of said cover contacts said dirt or gravel blocked by said plug, thereby causing said plug to move so that it no longer substantially closes the opening of the inner recess of the hinge receiving portion.

24. A closing device, comprising:

a frame defining an access opening;

a cover which is movable between a closed position of closing the access opening and an open position of leaving the access opening open; and a plug;

wherein the frame comprises a frame knuckle which receives an end of the cover;

wherein the plug is disposed in a recess below the end of the cover; and wherein, as least when the cover is in the closed position, the plug substantially closes an opening in the recess;

wherein the frame knuckle comprises an upper recess and a lower recess and there is an opening between the upper recess and the lower recess;

wherein, at least when the cover is in the closed position, the end of the cover is received in the upper recess; and wherein the plug is disposed in the lower recess.

25. A closing device according to claim 24, wherein the plug is an elastomer.

26. A closing device, comprising:

a frame defining an access opening;

a cover which is movable between a closed position of closing the access opening and an open position of leaving the access opening open; and a plug;

wherein the frame comprises a frame knuckle which receives an end of the cover;

wherein the plug is disposed in a recess below the end of the cover; and wherein, as least when the cover is in the closed position, the plug substantially closes an opening in the recess;

wherein the plug comprises two sealing lips;

wherein the sealing lips extend toward one another and ends of the sealing lips meet.

* * * * *